US007022034B2

(12) United States Patent
Sullivan et al.

(10) Patent No.: US 7,022,034 B2
(45) Date of Patent: Apr. 4, 2006

(54) GOLF BALL HAVING A NON-UNIFORM THICKNESS LAYER

(75) Inventors: Michael J. Sullivan, Barrington, RI (US); Derek A. Ladd, Fairhaven, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/293,645

(22) Filed: Nov. 13, 2002

(65) Prior Publication Data

US 2003/0119609 A1 Jun. 26, 2003

Related U.S. Application Data

(63) Continuation-in-part of application No. 09/815,753, filed on Mar. 23, 2001, now Pat. No. 6,494,795.

(51) Int. Cl.
*A63B 37/04* (2006.01)
*A63B 37/06* (2006.01)

(52) U.S. Cl. ..... 473/374

(58) Field of Classification Search ..... 473/351–378
See application file for complete search history.

(56) References Cited

U.S. PATENT DOCUMENTS 5,298,571 A * 3/1994 Statz et al. ..... 525/330.2
5,779,561 A * 7/1998 Sullivan et al. ..... 473/373
5,803,831 A * 9/1998 Sullivan et al. ..... 473/374
5,810,678 A * 9/1998 Cavallaro et al. ..... 473/373
5,820,485 A 10/1998 Hwang ..... 473/361
5,885,172 A * 3/1999 Hebert et al. ..... 473/354
5,957,784 A * 9/1999 Asakura et al. ..... 473/374
6,010,412 A * 1/2000 Moriyama ..... 473/373
6,042,488 A * 3/2000 Sullivan et al. ..... 473/374
6,290,611 B1 * 9/2001 Rajagopalan et al. ..... 473/371
6,293,877 B1 9/2001 Boehm ..... 473/371
6,342,019 B1 1/2002 Boehm et al. ..... 473/378
6,398,667 B1 * 6/2002 Lemons ..... 473/374
6,440,346 B1 8/2002 Wai et al. ..... 264/254
6,562,909 B1 * 5/2003 Morgan ..... 525/237
6,773,364 B1 * 8/2004 Sullivan et al. ..... 473/370
2001/0027140 A1 * 10/2001 Bellinger et al. ..... 473/356
2002/0086746 A1 7/2002 Bellinger et al. ..... 473/374

* cited by examiner

*Primary Examiner*—Eugene Kim
*Assistant Examiner*—Alvin A. Hunter, Jr.
(74) *Attorney, Agent, or Firm*—Kristin D. Wheeler

(57) ABSTRACT

A golf ball having a high rotational moment of inertial core assembly is disclosed. The core assembly may comprise a low specific gravity core and non-uniform thickness, high specific gravity intermediate layer. This sub-assembly is preferably encased within a soft cover. The low specific gravity core is preferably made from a foamed polymer or from a polymer with its specific gravity reduced, and the non-uniform thickness, high specific gravity core preferably has outer projections, inner projections or both disposed thereon. The projections increase the durability of the intermediate layer, thereby allowing polymers with high flexural modulus to be used as the intermediate layer. Alternatively, the inner and outer projections may extend circumferentially to form webs or ribs on the intermediate layer to increase its stiffness. The ball may comprise a second non-uniform thickness layer, wherein one or both of the intermediate layers comprise high specific gravity materials.

15 Claims, 3 Drawing Sheets

GOLF BALL HAVING A NON-UNIFORM THICKNESS LAYER

STATEMENT OF RELATED APPLICATION

This patent application is a continuation-in-part of U.S. patent application bearing Ser. No. 09/815,753 entitled "Golf Ball And A Method For Controlling The Spin Rate Of Same" and filed on Mar. 23, 2001 now U.S. Pat. No. 6,494,795. The parent application is incorporated herein by reference in its entirety.

FIELD OF THE INVENTION

The present invention relates to golf balls and more particularly, the invention is directed to a golf ball having a non-uniform thickness layer.

BACKGROUND OF THE INVENTION

Conventional golf balls can be divided into two general types or groups: solid balls or wound balls. The difference in play characteristics resulting from these different constructions can be quite significant. These balls, however, have primarily two functional components that make them work. These components are the center or core and the cover. The primary purpose of the core is to be the "spring" of the ball or the principal source of resiliency. The cover protects the core and improves the spin characteristics of the ball.

Two-piece solid balls are made with a single-solid core, usually made of a cross-linked polybutadiene or other rubber, which is encased by a cover. These balls are typically the least expensive to manufacture as the number of components is low and these components can be manufactured by relatively quick, automated molding techniques. In these balls, the solid core is the "spring" or source of resiliency. The resiliency of the core can be increased by increasing the cross-linking density of the core material. As the resiliency increases, however, the compression also increases making a harder ball, which is undesirable. Recently, commercially successful golf balls, such as the Titleist Pro-V1 golf balls, have a relatively large polybutadiene based core, ionomer casing and polyurethane cover, for long distance when struck by the driver clubs and controlled greenside play.

Moreover, the spin rate of golf balls is the end result of many variables, one of which is the distribution of the density or specific gravity within the ball. Spin rate is an important characteristic of golf balls for both skilled and recreational golfers. High spin rate allows the more skilled players, such as PGA professionals and low handicapped players, to maximize control of the golf ball. A high spin rate golf ball is advantageous for an approach shot to the green. The ability to produce and control back spin to stop the ball on the green and side spin to draw or fade the ball substantially improves the player's control over the ball. Hence, the more skilled players generally prefer a golf ball that exhibits high spin rate.

On the other hand, recreational players who cannot intentionally control the spin of the ball generally do not prefer a high spin rate golf ball. For these players, slicing and hooking are the more immediate obstacles. When a club head strikes a ball, an unintentional side spin is often imparted to the ball, which sends the ball off its intended course. The side spin reduces the player's control over the ball, as well as the distance the ball will travel. A golf ball that spins less tends not to drift off-line erratically if the shot is not hit squarely off the club face. The low spin ball will not cure the hook or the slice, but will reduce side spin and its adverse effects on play. Hence, recreational players prefer a golf ball that exhibits low spin rate.

However, the prior art does not disclose a golf ball that has a large core or "spring" and a high specific gravity, non-uniform thickness layer for controlled spin.

SUMMARY OF THE INVENTION

The present invention is directed to a golf ball with a controlled moment of inertia.

The present invention is preferably directed to a golf ball comprising an intermediate layer covering a core, wherein the intermediate layer is encased by a cover, wherein the intermediate layer comprises a non-uniform thickness layer, a maximum thickness in the range of about 0.010 inch to about 0.150 inch and a flexural modulus of greater than about 80,000 psi. The non-uniform thickness layer may comprise a plurality of projections disposed thereon, a plurality of longitudinal webs, a plurality of latitudinal webs, or a plurality of circumferential webs. Preferably, the maximum thickness of the non-uniform thickness layer is in the range of about 0.015 inch to about 0.100 inch. The profile of the projections is selected from a group consisting of trapezoidal, sinusoidal, dome, stepped, cylindrical, conical, truncated conical, rectangular, pyramidal with polygonal base, truncated pyramidal and polyhedronal. Alternatively, the non-uniform thickness layer comprises outer projections or inner projections.

Another aspect of the present invention is directed to a golf ball comprising an intermediate layer covering a core, wherein the intermediate layer is encased by a cover, wherein the intermediate layer comprises a continuous layer having non-uniform thickness, a specific gravity of at least about 1.2 and a moment of inertia of at least about 0.46 $oz \cdot inch^2$. The specific gravity of the non-uniform thickness layer may be at least about 1.5 or preferably at least about 2.0. The maximum thickness of the non-uniform thickness layer is preferably in the range of about 0.010 inch to about 0.150 inch, and more preferably in the range of about 0.015 inch to about 0.100 inch. Additionally, the flexural modulus of the non-uniform thickness layer is greater than about 30,000 psi, more preferably greater than about 50,000 psi and even more preferably greater than about 75,000 psi.

Preferably, the non-uniform thickness layer comprises a plurality of projections, and the profile of the projections is selected from a group consisting of trapezoidal, sinusoidal, dome, stepped, cylindrical, conical, truncated conical, rectangular, pyramidal with polygonal base, truncated pyramidal and polyhedronal. The projections can be outer or inner projections. Alternatively, the non-uniform thickness layer may comprise webs.

Another aspect of the invention is directed to a golf ball comprising an intermediate layer covering a core, wherein the intermediate layer is encased by a cover, wherein the intermediate layer comprises a non-uniform thickness layer having a plurality of circular webs disposed, thereon such that the webs increase the stiffness of the intermediate layer and wherein the ball has a coefficient of restitution of at least 0.76 at 160 feet per second. The compression of the core and intermediate layer is at least about 60 PGA, preferably at least about 80 PGA and more preferably at least about 90 PGA. The webs may be longitudinal webs, latitudinal webs or circumferential webs. The webs can be inner or outer webs. Preferably the flexural modulus of the non-uniform thickness layer is less than 30,000 psi. The golf ball also preferably has a coefficient of restitution is at least 0.80 at 125 feet per second.

The golf ball of the present invention may also comprise a second non-uniform thickness layer.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
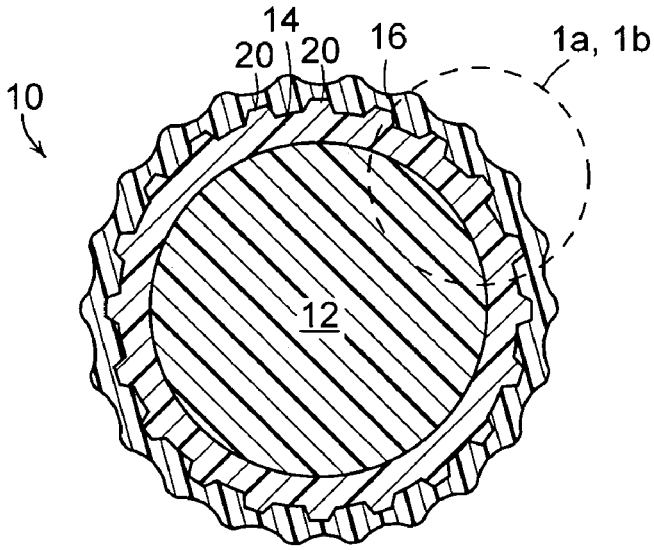
FIG. 1 is a cross-sectional view of a golf ball with a non-uniform thickness layer in accordance with the present invention.

It is well known that the total weight of the ball has to conform to the weight limit set by the United States Golf Association ("USGA"). Distributing the weight or mass of the ball either toward the center of the ball or toward the outer surface of the ball changes the dynamic characteristics of the ball at impact and in flight. Specifically, if the density is shifted or distributed toward the center of the ball, the moment of inertia is reduced, and the initial spin rate of the ball as it leaves the golf club would increase due to lower resistance from the ball's moment of inertia. Conversely, if the density is shifted or distributed toward the outer cover, the moment of inertia is increased, and the initial spin rate of the ball as it leaves the golf club would decrease due to the higher resistance from the ball's moment of inertia. The radial distance from the center of the ball or from the outer cover, where moment of inertia switches from being increased to being decreased as a result of the redistribution of weight or mass density, is an important factor in golf ball design.

In accordance to one aspect of the present invention, this radial distance, hereinafter referred to as the centroid radius, is provided. When more of the ball's mass or weight is reallocated to the volume of the ball from the center to the centroid radius, the moment of inertia is decreased, thereby producing a high spin ball. Hereafter, such a ball is referred as a low moment of inertia ball. When more of the ball's mass or weight is reallocated to the volume between the centroid radius and the outer cover, the moment of inertia is increased thereby producing a low spin ball. Hereafter, such a ball is referred as a high moment of inertia ball.

The centroid radius can be determined by following the steps below:

(a) Setting $R_o$ to half of the 1.68-inch diameter for an average size ball, where $R_o$ is the outer radius of the ball.

(b) Setting the weight of the ball to the USGA legal weight of 1.62 oz.

(c) Determining the moment of inertia of a ball with evenly distributed density prior to any weight distribution.

The moment of inertia is represented by $(2/5)(M_t)(R_o^2)$, where Mt is the total mass or weight of the ball. For the purpose of this invention, mass and weight can be used interchangeably. The formula for the moment of inertia for a sphere through any diameter is given in the CRC Standard Mathematical Tables, $24^{th}$ Edition, 1976 at 20 (hereinafter CRC reference). The moment of inertia of such a ball is 0.4572 oz-in$^2$. This will be the baseline moment of inertia value.

(d) Taking a predetermined amount of weight uniformly from the ball and reallocating this predetermined weight in the form of a thin shell to a location near the center of the ball and calculating the new moment of inertia of the weight redistributed ball.

This moment of inertia is the sum of the inertia of the ball with the reduced weight plus the moment of inertia contributed by the thin shell. This new moment of inertia is expressed as $(2/5)(M_r)(R_o^2)+(2/3)(M_s)(R_s^2)$, where Mr is the reduced weight of the ball; $M_s$ is the weight of the thin shell; and Rs is the radius of the thin shell measured from the center of the ball. Also, $M_t=M_r+M_s$. The formula of the moment of inertia from a thin shell is also given in the CRC reference.

(e) Comparing the new moment of inertia determined in step (d) to the baseline inertia value determined in step (c) to determine whether the moment of inertia has increased or decreased due to the reallocation of weight, i.e., subtracting the baseline inertia from the new inertia.

(f) Repeating steps (d) and (e) with the same predetermined weight incrementally moving away from the center of the ball until the predetermined weight reaches the outer surface of the ball.

(g) Determining the centroid radius as the radial location where the moment of inertia changes from increasing to decreasing.

(h) Repeating steps (d), (e), (f) and (g) with different predetermined weights and confirming that the centroid radius is the same for each predetermined weight.

In a preferred embodiment of the present invention, the predetermined weight is initially set at a very small weight, e.g., 0.01 oz, and the location of the thin shell is initially placed at 0.01 inch radially from the center of the ball. The 0.01 oz thin shell is then moved radially and incrementally away from the center. The results show that for a 1.62-oz ball with a 1.68-inch diameter, the centroid radius is approximately at 0.65 inch (16.5 mm) radially away from the center of the ball or approximately 0.19 inch (4.83 mm) radially inward from the outer surface. In other words, when the reallocated weight is positioned at a radial distance about 0.65 inch, the new moment of inertia of the ball is the same as the baseline moment of inertia of a uniform density ball. To ensure that the preferred method of determining the centroid radius discussed above is a correct one, the same calculation was repeated for predetermined weights of 0.20 oz, 0.405 oz (¼ of the total weight of the ball), 0.81 oz (½ of the total weight) and 1.61 oz (practically all of the weight). In each case, the centroid radius is located at the same radial distance, i.e., at approximately 0.65 inch radially from the center of a ball weighing 1.62 oz and with a diameter of 1.68 inches, or 0.19 inch from the outer surface of the ball. The procedure for calculating the centroid radius is fully described in the co-pending parent application, which has been incorporated by reference in its entirety.

In accordance to the above calculations, the moment of inertia for a 1.62 oz and 1.68 inch golf ball with evenly distributed weight through any diameter is 0.4572 oz·inch 2. Hence, moments of inertia higher than about 0.46 oz·inch$^2$ would be considered as a high moment of inertia ball. For example, a golf ball having a thin shell positioned at about 0.040 inch from the outer surface of the golf ball (or 0.800 inch from the center), has the following moments of inertia.

| Weight (oz) of Thin Shell | Moment of Inertia (oz · inch$^2$) |
|---|---|
| 0.20 | 0.4861 |
| 0.405 | 0.5157 |
| 0.81 | 0.5742 |
| 1.61 | 0.6898 |

For a high moment of inertia ball, the moment of inertia is preferably greater than 0.50 oz·in$^2$ and more preferably greater than 0.575$^2$.

Figure 1A:
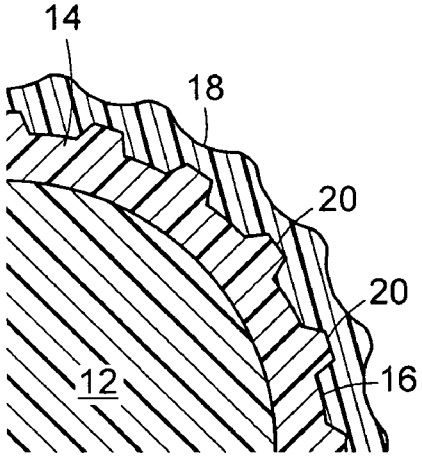
FIG. 1*a* is a partial enlarged view of a portion of the golf ball of FIG. 1.
Figure 1B:
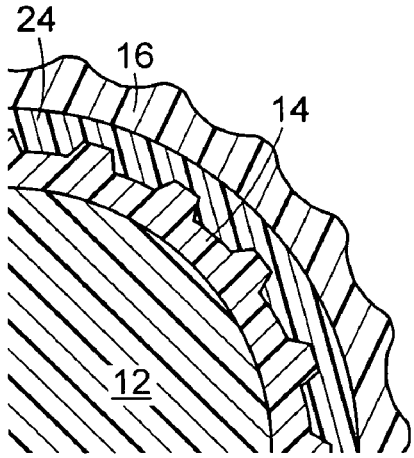
FIG. 1*b* is an alternative embodiment of FIG. 1*a;*

In accordance to one aspect of the invention, ball 10 is a high moment of inertia ball comprising a low specific gravity inner core 12, encompassed by a high specific gravity intermediate layer 14, which preferably has non-uniform thickness, as shown in FIGS. 1, 1*a* and 1*b*. At least a portion of inner core 12 is made with a cellular material, a density reducing filler or is otherwise reduced in density, e.g., with foam. Inner core 12 and intermediate layer 14 are further encased within a cover 16 with dimples 18. Preferably, the cover does not have a density adjusting element, except for pigments, colorants, stabilizers and other additives employed for reasons other than adjusting the density of the cover. The high specific gravity, non-uniform thickness intermediate layer 14 is positioned radially outward relative to the centroid radius. Ball 10, therefore, advantageously has a high moment of rotational inertia and low initial spin rates to reduce slicing and hooking when hit with a driver club.

Figure 2A:
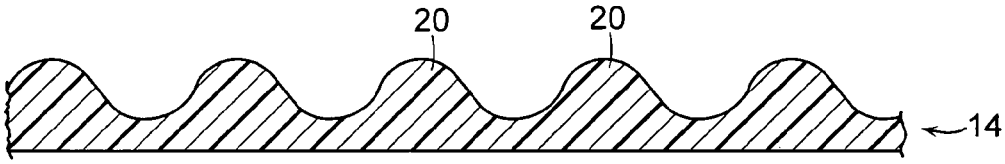
FIGS. 2*a*–2*e* are partial planar views of alternative embodiments of the non-uniform thickness layer in accordance to the present invention.
Figure 2B:
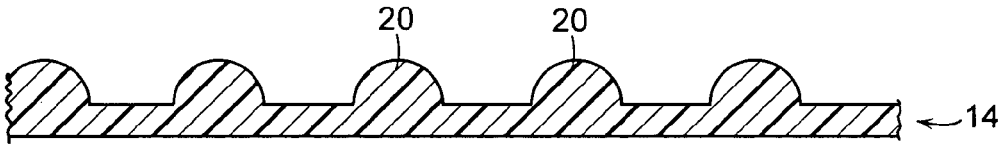
Figure 2C:
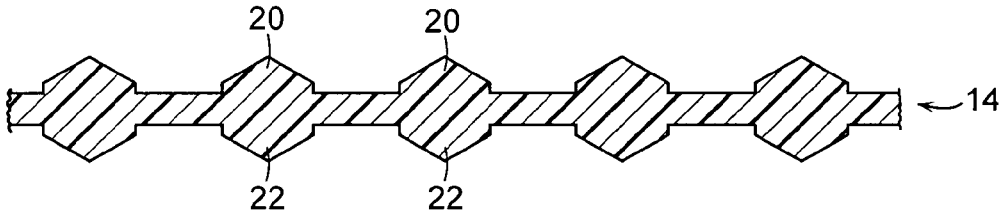
Figure 2D:
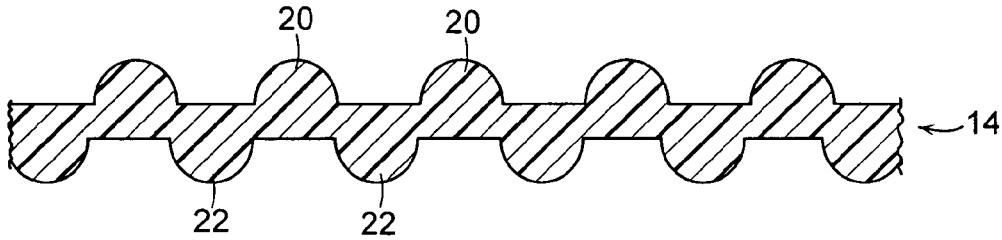
Figure 2E:
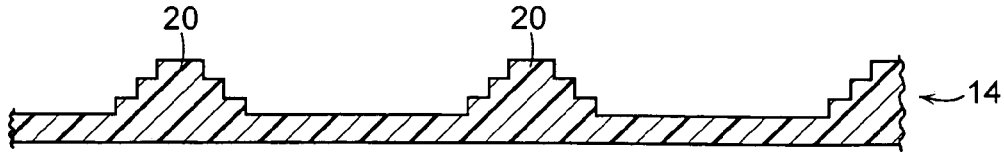

Preferably, intermediate layer 14 also has a non-uniform thickness, i.e., its thickness varies throughout the ball around core 12. As used herein, a non-uniform thickness layer includes, but not limited to, a layer having projections, webs, ribs or any other structures disposed thereon such that its thickness varies. In accordance to one aspect of the invention shown in FIGS. 1 and 1*a*, non-uniform thickness layer 14 may comprise a plurality of outer projections 20 disposed on the outer surface of intermediate layer 14. As illustrated, outer projections 20 are made integral with layer 14. However, as discussed below projections 20 may be made separately and then are attached to the intermediate layer 14. Outer projections 20 may have any shape or profile, including but not limited to, trapezoidal as shown in FIGS. 1, 1*a* and 1*b*, or sinusoidal, dome or stepped as shown in FIGS. 2*a*, 2*b* and 2*e*, respectively. Additionally, layer 14 may also have inner projections 22 that are disposed on the inner surface of intermediate layer 14, as shown in FIGS. 2*c* and 2*d*. Inner projections 22 similarly may have any shape or profile, and may be aligned with the outer projections as shown in FIG. 2*e* or may by unaligned with the outer projections as shown in FIG. 2*d*. The inner projections may also be partially aligned with the outer projections, or alternatively may exist without the outer projections.

Projections 20 and 22 may also have any of the shapes and profiles disclosed in commonly owned U.S. Pat. No. 6,293,877 B1, including but not limited to, cylindrical, conical, truncated conical, rectangular, pyramidal with polygonal base, truncated pyramidal and polyhedronal. The disclosure of the '877 patent, including the written description and drawings are incorporated herein by reference in its entirety.

The non-uniform thickness intermediate layer 14 preferably has the highest specific gravity of all the layers in ball 10. Preferably, the specific gravity of layer 14 is greater than about 1.2, more preferably greater than about 1.5 and most preferably greater than about 2.0. The term specific gravity, as used herein, has its ordinary and customary meaning, i.e., the ratio of the density of a substance to the density of water at 4° C., and the density of water at this temperature is 1 g/cm$^3$. Alternatively, the specific gravity can be as high as 5.0, 10.0 or more. Intermediate layer 14 may be made from a high density metal or from metal powder encased in a polymeric binder. High density metals such as steel, tungsten (specific gravity of about 19), lead, brass, bronze, copper, nickel, molybdenum, or alloys may be used. Intermediate layer 14 may comprise multiple discrete layers of various metals or alloys. Alternatively, a loaded thin film or "pre-preg" or a "densified loaded film," as described in U.S. Pat. No. 6,010,411 related to golf clubs, may be used as the thin film layer in a compression molded or otherwise in a laminated form applied inside the cover layer 16. The "pre-preg" disclosed in the '411 patent may be used with or without the fiber reinforcement, so long as the preferred specific gravity and preferred thickness levels are satisfied. The loaded film comprises a staged resin film that has a densifier or weighing agent, preferably copper, iron or tungsten powder evenly distributed therein. The resin may be partially cured such that the loaded film forms a malleable sheet of varying thickness that may be cut to desired size and shape, and then applied to the outside or inside of an intermediate layer to form the non-uniform thickness layer. Such films are available from the Cytec of Anaheim, Calif. or Bryte of San Jose, Calif.

Non-uniform thickness layer 14 preferably made from a durable material such as metal, flexible or rigid plastics, high strength organic or inorganic fibers, any material that has a high Young's modulus, or blends or composites thereof. Suitable metals include, but not limited to, tungsten, steel, titanium, chromium, nickel, copper, aluminum, zinc, magnesium, lead, tin, iron, molybdenum and alloys thereof. Suitable plastics or polymers include, but not limited to, one or more of partially or fully neutralized ionomers including those neutralized by a metal ion source wherein the metal ion is the salt of an organic acid, polyolefins including polyethylene, polypropylene, polybutylene and copolymers thereof including polyethylene acrylic acid or methacrylic acid copolymers, or a terpolymer of ethylene, a softening acrylate class ester such as methyl acrylate, n-butyl-acrylate or iso-butyl-acrylate, and a carboxylic acid such as acrylic acid or methacrylic acid (e.g., terpolymers including polyethylene-methacrylic acid-n or iso-butyl acrylate and polyethylene-acrylic acid-methyl acrylate, polyethylene ethyl or methyl acrylate, polyethylene vinyl acetate, polyethylene glycidyl alkyl acrylates). Suitable polymers also include metallocene catalyzed polyolefins, polyesters, polyamides, non-ionomeric thermoplastic elastomers, copolyether-esters, copolyether-amides, thermoplastic or thermosetting polyurethanes, polyureas, polyurethane ionomers, epoxies, polycarbonates, polybutadiene, polyisoprene, and blends thereof. Suitable polymeric materials also include those listed in U.S. Pat. Nos. 6,187,864, 6,232,400, 6,245,862, 6,290,611 and 6,142,887 and in PCT publication no. WO 01/29129.

Suitable highly rigid materials include those listed in columns 11, 12 and 17 of U.S. Pat. No. 6,244,977. Fillers with very high specific gravity such as those disclosed in U.S. Pat. No. 6,287,217 at columns 31–32 can also be incorporated into the non-uniform thickness layer. Suitable fillers and composites include, but not limited to, carbon including graphite, glass, aramid, polyester, polyethylene, polypropylene, silicon carbide, boron carbide, natural or synthetic silk.

Additional suitable high specific gravity materials for the intermediate layer 14 and suitable methods such as lamination for assembling intermediate layer 14 on to core 12 are fully disclosed in co-pending patent application entitled "Multi-layered Core Golf Ball" bearing Ser. No. 10/002,641, filed on Nov. 28, 2001, and this application is incorporated herein in its entirety. The disclosed materials and methods are fully adaptable for use with the non-continuous thickness layer 14 of the present invention. More specifically, partially cured layer 14 may be cut into figure-8-shaped or barbell like patterns, similar to a baseball or tennis ball cover. Other patterns such as curved triangles and semi-spheres can also be used. These patterns are laid over an uncured core and then the sub-assembly is cured to lock the non-continuous layer on to the substrate.

In accordance to another aspect of the invention, a golf ball may have a non-uniform thickness intermediate layer and a uniform thickness intermediate layer, or two non-uniform thickness intermediate layers. For example, as illustrated in FIG. 1*b*, ball 10 further comprises a second intermediate layer disposed between intermediate layer 14 and cover 16. Preferably, second intermediate layer 24 is another non-uniform thickness layer configured and dimensioned to have its inner projections match with outer projections 20 of layer 14. As illustrated, second intermediate layer 24 presents a smooth outer surface for cover 16 to be molded thereon. On the other hand, when cover 16 is disposed adjacent to non-uniform layer 14 it is configured and dimensioned to have its own inner projections matching outer projections 22 of layer 14.

The second intermediate layer 24 can be made out of the same material as intermediate layer 14, or it can be made out of any core or cover materials described herein. Second intermediate layer 24 can be another high specific gravity layer for increased moment of inertia. Alternatively, it can be foamed or otherwise softened to provide better controlled play. Preferably, the projections cover more than about 25% of the surface of the intermediate layer, and more preferably greater than about 50%. The projections may cover up to about 90% of the surface of the intermediate layer.

The non-uniform thickness layers 14, 24 may be manufactured by casting, injection molding over the core 12, or by adhering injection or compression molded half-shells to the core by compression molding, laminating, gluing, wrapping, bonding or otherwise affixed to the core.

An advantage of utilizing projections 20, 22 is that polymers that have relatively high flexural modulus or are brittle or non-flexing can be utilized as the intermediate layers. Projections 20, 22 provide the intermediate layers with more durability to endure repeated impacts by golf clubs. Preferably, the maximum thickness, i.e., measured at the thickest location of the non-uniform thickness layer, is in the range of 0.010 inch to about 0.150 inch and more preferably between 0.015 inch and 0.100 inch. The flexural modulus of the intermediate layer 14 is about 30,000 psi or higher, preferably 50,000 psi or higher, and more preferably 75,000 psi or higher, as measured in accordance to ASTM D6272-98 about two weeks after the test specimen are prepared. Advantageously, engineered polymers, such as polycarbonate or polyamide, with flexural modulus of 300,000 psi or higher, could be used with or without impact modification in a golf ball as a non-uniform thickness layer.

In accordance to another aspect of the present invention, the non-uniform thickness layer can be used to maintain the coefficient of restitution (CoR) of golf balls with low compression value. Generally, golf balls made with a relative soft core compression experiences a decrease in CoR at higher impact speeds with golf clubs. The methods for measuring and calculating CoR are discussed in details below. For example, a first golf ball with a 1.505 inch core and a core compression of 48 (hereinafter "Sample-48") and a second golf ball with a 1.515 inch core and a core compression of 80 (hereinafter "Sample-80") were subject to the following distance and CoR tests. Sample-48 and Sample-80 have essentially the same size core and similar dual-layer cover. The single most significant difference between these two balls is the compression of the respective cores.

| | | Ball Speed (feet per second) | | | |
|---|---|---|---|---|---|
| | Compression On Ball | Average Driver Set-up | Standard Driver Set-up | Pro 167 Driver Set-up | Big Pro 175 Driver Set-up |
| Sample-48 | 86 | 141.7 | 162.3 | 167.0 | 175.2 |
| Sample-80 | 103 | 141.5 | 162.1 | 168.9 | 176.5 |

| | | Coefficient of Restitution (CoR) | | | |
|---|---|---|---|---|---|
| | Compression On Ball | Mass Plate (125 ft/s) | Mass Plate (160 ft/s) | 200-gram Solid Plate (160 ft/s) | 199.8-gram Calibration Plate (160 ft/s) |
| Sample-48 | 86 | 0.812 | 0.764 | 0.759 | 0.818 |
| Sample-80 | 103 | 0.796 | 0.759 | 0.753 | 0.836 |
| Difference (Sample-48 − Sample-80) | | +0.016 | +0.005 | +0.006 | −0.018 |

As used in the ball speed test, the "average driver set-up" refers to a set of launch conditions, i.e., at a club head speed to which a mechanical golf club has been adjusted so as to generate a ball speed of about 140 feet per second. Similarly, the "standard driver set-up" refers to similar ball speed at launch conditions of about 160 feet per second; the "Pro 167 set-up" refers to a ball speed at launch conditions of about 167 feet per second; and the "Big Pro 175 set-up" refers to a ball speed at launch conditions of about 175 feet per second. Also, as used in the CoR test, the mass plate is a 45-kilogram plate (100 lbs) against which the balls strike at the indicated speed. The 200-gram solid plate is a smaller mass that the balls strike and resembles the mass of a club head. The 199.8-gram calibration plate resembles a driver with a flexible face that has a CoR of 0.830.

The ball speed test results show that while Sample-48 holds a ball speed advantage at club speeds of 140 feet per second to 160 feet per second launch conditions, Sample-80 decidedly has better ball speed at 167 feet per second and 175 feet per second launch conditions.

Similarly, the CoR test results show that at the higher collision speed (160 feet per second), the CoR generally goes down for both balls, but the 199.8-gram calibration test shows that the CoR of the higher compression Sample-80 is significantly better than the lower compression Sample-48 at the collision speed (160 feet per second). Additionally, while the CoR generally goes down for both balls, the rate of decrease is much less for Sample-80 than for Sample-48. Unless specifically noted, CoR values used hereafter are measured by either the mass plate method or the 200-gram solid plate method, i.e., where the impact plate is not flexible.

Without being limited to any particular theory, the inventors of the present invention believe that at high impact, the ball with lower core compression deforms more than the ball with higher core compression. Such deformation negatively affects the initial velocity and CoR of the ball.

Figure 3A:
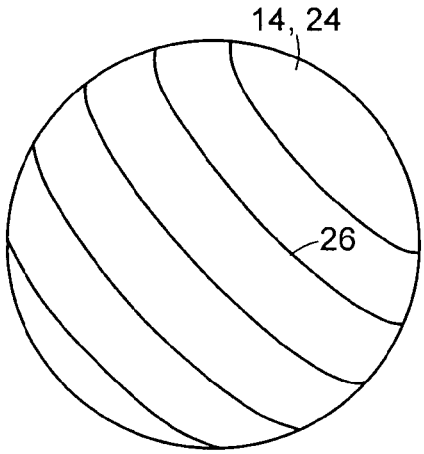
FIGS. 3*a*–3*c* are schematic views of other alternative embodiments of the non-uniform thickness layer in accordance to the present invention.
Figure 3B:
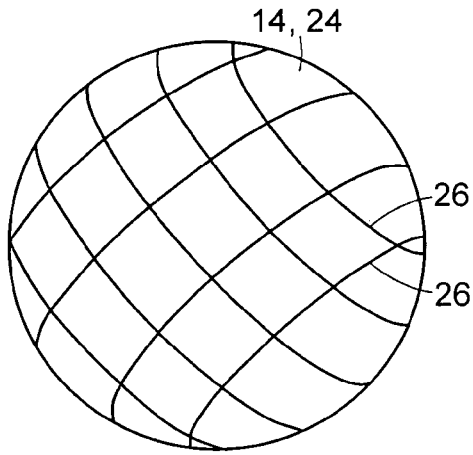
Figure 3C:
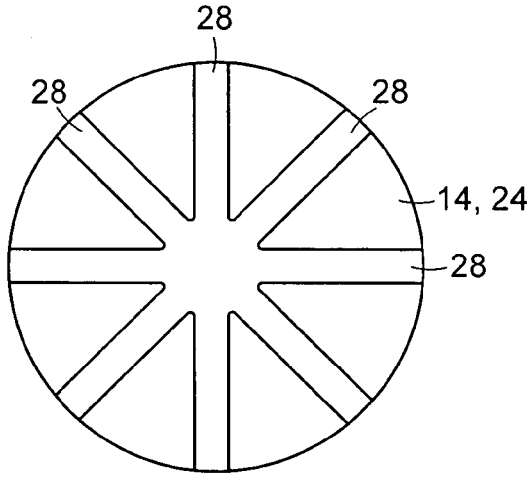

In accordance to this aspect of the present invention, projections 20, 22 are interconnected to form continuous patterns on intermediate layers 14, 24 as longitudinal or latitude webs or ribs 26, as shown in FIGS. 3*a* and 3*b*, or circumferential webs or ribs 28, as shown in FIG. 3*c*, intersecting at the poles. An advantage of utilizing webs or ribs 26, 28 in a non-uniform thickness layer is to increase its stiffness, such that the webs or ribs carry a portion of the load or impact applied to the golf ball. The load carried by webs or ribs 26, 28 is proportional to the stiffness of the webs or ribs to the total stiffness of the entire non-uniform thickness layer. Hence, adding webs or ribs reduces the deflection of the intermediate layer 14, 24 under load, thereby increasing the resilience of layer 14, 24 and increasing the coefficient of restitution of golf ball 10. Hence, such webs or ribs 26 can be used with a lower compression golf ball core to maintain CoR at a high level. Additionally, employing webs or ribs 26, 28 allows polymers with relatively low flexural modulus, such as 30,000 psi or less, to be employed without the addition of reinforcing fillers. Webs or ribs 26, 28 may have a narrow width as shown in FIG. 3*a* or wide width as shown in FIG. 3*b*.

In accordance to this aspect of the present invention, preferably core 12 has a compression of less than about 50 PGA, and/or the sub-assembly of core 12 and non-uniform thickness layer 14, preferably with webs or ribs 26, has a compression greater than about 60 PGA, more preferably greater than about 80 PGA and most preferably greater than about 90 PGA. A golf ball according to this aspect of the present invention has a CoR of at least 0.80 at 125 feet per second and more preferably of at least 0.76 at 160 feet per second.

As stated above, at least a portion of core 12 may comprise a density reducing filler, or otherwise may have its specific gravity reduced, e.g., by foaming the polymer. The effective specific gravity for this low specific gravity layer is preferably less than 1.1, more preferably less than 1.0 and even more preferably less than 0.9. The actual specific gravity is determined and balanced based upon the specific gravity and physical dimensions of the intermediate layer 14 and the outer core 16.

The low specific gravity layer can be made from a number of suitable materials, so long as the low specific gravity layer is durable, and does not impart undesirable characteristics to the golf ball. Preferably, the low specific gravity layer contributes to the soft compression and resilience of the golf ball. The low specific gravity layer can be made from a thermosetting syntactic foam with hollow sphere fillers or microspheres in a polymeric matrix of epoxy, urethane, polyester or any suitable thermosetting binder, where the cured composition has a specific gravity of less than 1.1 and preferably less than 0.9. Suitable materials may also include a polyurethane foam or an integrally skinned polyurethane foam that forms a solid skin of polyurethane over a foamed substrate of the same composition. Alternatively, suitable materials may also include a nucleated reaction injection molded polyurethane or polyurea, where a gas, typically nitrogen, is essentially whipped into at least one component of the polyurethane, typically, the pre-polymer, prior to component injection into a closed mold where full reaction takes place resulting in a cured polymer having a reduced specific gravity. Furthermore, a cast or RIM polyurethane or polyurea may have its specific gravity further reduced by the addition of fillers or hollow spheres, etc. Additionally, any number of foamed or otherwise specific gravity reduced thermoplastic polymer compositions may also be used such as metallocene-catalyzed polymers and blends thereof described in U.S. Pat. Nos. 5,824,746 and 6,025,442 and in PCT International Publication No. WO 99/52604. Moreover, any materials described as mantle or cover layer materials in U.S. Pat. Nos. 5,919,100, 6152,834 and 6,149,535 and in PCT International Publication Nos. WO 00/57962 and WO 01/29129 with its specific gravity reduced are suitable materials. Disclosures from these references are hereby incorporated by reference. The low specific gravity layer can also be manufactured by a casting method, sprayed, dipped, injected or compression molded.

Low specific gravity materials that do not have its specific gravity modified are also suitable for core 12. The specific gravity of this layer may also be less than 0.9 and preferably less than 0.8, when materials such as metallocenes, ionomers, or other polyolefinic materials are used. Other suitable materials include polyurethanes, polyurethane ionomers, interpenetrating polymer networks, Hytrel® (polyester-ether elastomer) or Pebax® (polyamide-ester elastomer), etc., which may have specific gravity of less than 1.0. Additionally, suitable unmodified materials are also disclosed in U.S. Pat. Nos. 6,419,535, 6,152,834, 5,919,100, 5,885,172 and WO 00/57962. These references have already been incorporated by reference. The core may also include one or more layers of polybutadiene encased in a layer or layers of polyurethane. The non-reduced specific gravity layer can be manufactured by a casting method, reaction injection molded, injected or compression molded, sprayed or dipped method.

The cover layer 16 is preferably a resilient, non-reduced specific gravity layer. Suitable materials include any material that allows for tailoring of ball compression, coefficient of restitution, spin rate, etc. and are disclosed in U.S. Pat. Nos. 6,419,535, 6,152,834, 5,919,100 and 5,885,172. Ionomers, ionomer blends, thermosetting or thermoplastic polyurethanes, metallocenes are the preferred materials. The cover can be manufactured by a casting method, reaction injection molded, injected or compression molded, sprayed or dipped method. When cover 16 is disposed adjacent to non-uniform layer 14, as shown in FIG. 1*a*, cover 16 is preferably manufactured by injection molding molten thermoplastic polymer so that the cover material can flow into the spaces between projections 22. Alternatively, cover 16 can also be made by compression molding two halves of semi-cured thermosetting polymer to conform around projections 22.

In accordance to another aspect of the present invention, it has been found that by creating a golf ball with a low spin construction, such as low specific gravity core 12 and non-uniform thickness, high specific gravity intermediate layer 14 of ball 10 discussed above, but adding a cover 16 of a thin layer of a relatively soft thermoset material formed from a castable reactive liquid, a golf ball with "progressive performance" from driver to wedge can be formed. As used herein, the term "thermoset" material refers to an irreversible, solid polymer that is the product of the reaction of two or more prepolymer precursor materials.

The thickness of the outer cover layer is important to the "progressive performance" of the golf balls of the present invention. If the outer cover layer is too thick, this cover layer will contribute to the in-flight characteristics related to the overall construction of the ball and not the cover surface properties. However, if the outer cover layer is too thin, it will not be durable enough to withstand repeated impacts by the golfer's clubs. It has been determined that the outer cover layer should have a thickness of less than about 0.05 inch, preferably between about 0.02 and about 0.04 inch. Most preferably, this thickness is about 0.03 inch.

The outer cover layer is formed from a relatively soft thermoset material in order to replicate the soft feel and high spin play characteristics of a balata ball when the balls of the present invention are used for pitch and other "short game" shots. In particular, the outer cover layer should have a Shore D hardness from about 30 to about 80, preferably 35–50 and most preferably 40–45, as measured in accordance to ASTM D 2240-00 standard. Additionally, the materials of the outer cover layer must have a degree of abrasion resistance in order to be suitable for use as a golf ball cover. The outer cover layer of the present invention can comprise any suitable thermoset material which is formed from a castable reactive liquid material. The preferred materials for the outer cover layer include, but are not limited to, thermoset urethanes and polyurethanes, thermoset urethane ionomers, thermoset urethane epoxies and thermoset polyureas or polyurethane-ureas. Examples of suitable polyurethane ionomers are disclosed in U.S. Pat. No. 5,692,974 entitled "Golf Ball Covers," the disclosure of which is hereby incorporated by reference in its entirety in the present application.

Alternatively the cover may comprise a thermoplastic polyurethane, polyurea, partially or fully neutralized ionomer, metallocene or other single site catalyzed polymer, polyester, polyamide, non-ionomeric thermoplastic elastomer, copolyether-esters, copolyether-amides, polycarbonate, polybutadiene, polyisoprene, polystryrene block copolymers such as styrene-butadiene-styrene, styrene-ethylene-propylene-styrene, styrene-ethylene-butylene-styrene, etc. and blends thereof.

Thermosetting polyurethanes or polyureas are particularly preferred for the outer cover layers of the balls of the present invention. Polyurethane is a product of a reaction between a polyurethane prepolymer and a curing agent. The polyurethane prepolymer is a product formed by a reaction between a polyol and a diisocyanate. The curing agent is typically either a diamine or glycol. Often a catalyst is employed to promote the reaction between the curing agent and the polyurethane prepolymer. Thermosetting polyureas or polyurethanes can be formed into the cover layer by reaction injection molding.

Conventionally, thermoset polyurethanes are prepared using a diisocyanate, such as 2,4-toluene diisocyanate (TDI) or methylenebis-(4-cyclohexyl isocyanate) (HMDI) and a polyol which is cured with a polyamine, such as methylenedianiline (MDA), or a trifunctional glycol, such as trimethylol propane, or tetrafunctional glycol, such as N,N,N',N'-tetrakis(2-hydroxpropyl)ethylenediamine. However, the present invention is not limited to just these specific types of thermoset polyurethanes. Quite to the contrary, any suitable thermoset polyurethane may be employed to form the outer cover layer of the present invention.

As used herein, compression is measured by applying a spring-loaded force to the golf ball center, golf ball core or the golf ball to be examined, with a manual instrument (an "Atti gauge") manufactured by the Atti Engineering Company of Union City, N.J. This machine, equipped with a Federal Dial Gauge, Model D81-C, employs a calibrated spring under a known load. The sphere to be tested is forced a distance of 0.2 inch (5 mm) against this spring. If the spring, in turn, compresses 0.2 inch, the compression is rated at 100; if the spring compresses 0.1 inch, the compression value is rated as 0. Thus more compressible, softer materials will have lower Atti gauge values than harder, less compressible materials. Compression measured with this instrument is also referred to as PGA compression. The approximate relationship that exists between Atti or PGA compression and Riehle compression can be expressed as:

(Atti or PGA compression)=(160-Riehle Compression).

Thus, a Riehle compression of 100 would be the same as an Atti compression of 60.

The coefficient of restitution (CoR) is the ratio of the relative velocity between two objects after direct impact to the relative velocity before impact. As a result, the CoR can vary from 0 to 1, with 1 being equivalent to a perfectly or completely elastic collision and 0 being equivalent to a perfectly plastic or completely inelastic collision. Since a ball's CoR directly influences the ball's initial velocity after club collision and travel distance, golf ball manufacturers are interested in this characteristic for designing and testing golf balls.

One conventional technique for measuring CoR uses a golf ball or golf ball subassembly, air cannon, and a stationary steel plate. The steel plate provides an impact surface weighing about 100 pounds or about 45 kilograms. A pair of ballistic light screens, which measure ball velocity, are spaced apart and located between the air cannon and the steel plate. The ball is fired from the air cannon toward the steel plate over a range of test velocities from 50 ft/s to 180 ft/sec. As the ball travels toward the steel plate, it activates each light screen so that the time at each light screen is measured. This provides an incoming time period proportional to the ball's incoming velocity. The ball impacts the steel plate and rebounds though the light screens, which again measure the time period required to transit between the light screens. This provides an outgoing transit time period proportional to the ball's outgoing velocity. The coefficient of restitution can be calculated by the ratio of the outgoing transit time period to the incoming transit time period, $CoR=T_{out}/T_{in}$.

Another CoR measuring method uses a titanium disk. The titanium disk intending to simulate a golf club is circular, and has a diameter of about 4 inches, and has a mass of about 200 grams. The impact face of the titanium disk may also be flexible and has its own coefficient of restitution, as discussed further below. The disk is mounted on an X-Y-Z table so that its position can be adjusted relative to the launching device prior to testing. A pair of ballistic light screens are spaced apart and located between the launching device and the titanium disk. The ball is fired from the launching device toward the titanium disk at a predetermined test velocity. As the ball travels toward the titanium disk, it activates each light screen so that the time period to transit between the light screens is measured. This provides an incoming transit time period proportional to the ball's incoming velocity. The ball impacts the titanium disk, and rebounds through the light screens which measure the time period to transit between the light screens. This provides an outgoing transit time period proportional to the ball's outgoing velocity. CoR can be calculated from the ratio of the outgoing time period to the incoming time period along with the mass of the disk and ball:

$$CoR = \frac{(T_{out}/T_{in}) \times (M_e + M_b) + M_b}{M_e}$$

While various descriptions of the present invention are described above, it is understood that the various features of the present invention can be used singly or in combination thereof. Therefore, this invention is not to be limited to the specifically preferred embodiments depicted therein.

What is claimed is:

1. A golf ball comprising an intermediate layer covering a core, wherein the intermediate layer is encased by a cover made of a thermoset material, wherein the intermediate layer comprises a non-uniform thickness layer being a layer having a plurality of circular webs disposed thereon such that the webs increase the stiffness of the intermediate layer and wherein the ball has a coefficient of restitution of at least 0.76 at 160 feet per second, wherein the core has a first compression of less than 50 and the core and intermediate layer has a second compression of at least 60 PGA, and wherein the core is comprised of a density reducing filler such that it has a specific gravity of less than about 1.1.

2. The golf ball as set forth in claim 1, wherein the second compression of the core and intermediate layer is at least about 80 PGA.

3. The golf ball as set forth in claim 1, wherein the second compression of the core and the intermediate layer is at least about 90 PGA.

4. The golf ball as set forth in claim 1, wherein the webs comprise a plurality of longitudinal webs.

5. The golf ball as set forth in claim 1, wherein the webs comprise a plurality of latitudinal webs.

6. The golf ball as set forth in claim 1, wherein the webs comprise a plurality of circumferential webs.

7. The golf ball as set forth in claim 1, wherein the flexural modulus of the non-uniform thickness layer is less than 30,000 psi.

8. The golf ball as set forth in claim 1, wherein the webs comprise outer webs.

9. The golf ball as set forth in claim 1, wherein the webs comprise inner webs.

10. The golf ball as set forth in claim 1, further comprising a second non-uniform thickness layer.

11. The golf ball as set forth in claim 1, wherein the coefficient of restitution is at least 0.80 at 125 feet per second.

12. A golf ball comprising an intermediate layer covering a core, wherein the intermediate layer is encased by a cover made of thermoset material, wherein the intermediate layer comprises a non-uniform thickness layer being a layer having a plurality of circular webs disposed thereon such that the webs increase the stiffness of the intermediate layer and wherein the ball has a coefficient of restitution of at least 0.76 at 160 feet per second, and further comprising a low specific gravity of that contributes to the soft compression and resilience of the golf ball, wherein the low specific gravity layer has a specific gravity of less than about 1.1.

13. The golf ball as set forth in claim 12, wherein the low specific gravity layer is comprised of a thermosetting syntactic foam.

14. The golf ball as set forth in claim 12, wherein the low specific gravity layer is comprised of a polyurethane foam.

15. A golf ball comprising an intermediate layer covering a core, wherein the intermediate layer is encased by a cover made of a thermoset material, wherein the intermediate layer comprises a non-uniform thickness layer being a layer having a plurality of circular webs disposed thereon such that the webs increase the stiffness of the intermediate layer and wherein the ball has a coefficient of restitution of at least 0.76 at 160 feet per second, wherein the core has a first compression of less than 50 and the core and intermediate layer has a second compression of at least about 60 PGA, and wherein the intermediate layer has a specific gravity of greater than about 1.2.

* * * * *